US006815410B2

(12) United States Patent
Boutique et al.

(10) Patent No.: US 6,815,410 B2
(45) Date of Patent: Nov. 9, 2004

(54) POUCHED CLEANING COMPOSITIONS

(75) Inventors: Jean-Pol Boutique, Gembloux (BE); James Charles Theophile Roger Burckett-Saint-Laurent, Brussels (BE); Steven Jozef Louis Coosemans, Kampenhout (BE); Luca Goovaerts, Haacht (BE); Lorenzo Matteo Pierre Gualco, Brussels (BE); James Pyott Johnston, Merchtem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/418,911

(22) Filed: Apr. 17, 2003

(65) Prior Publication Data

US 2003/0199414 A1 Oct. 23, 2003

(30) Foreign Application Priority Data

Apr. 19, 2002 (EP) ..... 02447068

(51) Int. Cl.[7] ..... C11D 17/00

(52) U.S. Cl. ..... 510/295; 510/297; 510/439; 510/298; 510/499; 510/424

(58) Field of Search ..... 510/295, 296, 510/438, 439, 297, 298, 499, 424

(56) References Cited

U.S. PATENT DOCUMENTS 4,610,799 A 9/1986 Wilsberg et al.

4,973,416 A 11/1990 Kennedy

FOREIGN PATENT DOCUMENTS

| | | |
|---|---|---|
| DE | 19949980 A1 | 4/2001 |
| EP | 1 120 459 | 8/2001 |
| EP | 1120459 A1 | 8/2001 |
| GB | 2358191 A | 7/2001 |
| WO | WO 01/79416 | 10/2001 |
| WO | WO 01/79417 | 10/2001 |
| WO | WO 01/83658 A2 | 11/2001 |

OTHER PUBLICATIONS

US–2002/0045559 A1.

*Primary Examiner*—Necholus Ogden
(74) *Attorney, Agent, or Firm*—Laura R. Grunzinger; Armina E. Matthews; Brahm J. Corstanje

(57) ABSTRACT

The present invention relates to a pouched cleaning composition wherein the pouch is constructed from a water-soluble film and contains a liquid composition comprising less than 5% by weight of the liquid composition, of water; an anionic surfactant; and at least 0.5% by weight of the liquid composition of a builder/chelant free of C8–22 alkyl or alkenyl chains characterized by a solubility in said liquid composition of less than 0.3% by weight. Such pouched cleaning compositions provide better cleaning performance and better pouch solubility while avoiding the formation of residues.

16 Claims, No Drawings

POUCHED CLEANING COMPOSITIONS

FIELD OF THE INVENTION

This invention relates to unit dose compositions for cleaning laundry, in particular to unit dose laundry liquid detergents comprising sequestrants and incorporated in water-soluble pouches.

BACKGROUND TO THE INVENTION

Cleaning/care compositions come in a number of product forms, such as granules, liquids, tablets, and pouches each form having its own advantages and disadvantages.

Recently, water-soluble pouches containing washing, cleaning or care actives have become popular. In general, the pouches comprise a liquid or powder detergent composition surrounded by a water-soluble film, such as polyvinyl alcohol. These products have the advantage that they are convenient to dose, easy to handle and cause little mess in comparison with traditional detergent forms. However, they are difficult to make economically and have some limitations such as a tendency to leak or to leave residues, for example residues derived from the pouch material incompletely dissolving or dispersing.

The pouched cleaning composition must be able to disintegrate quickly and completely without residue being left in the drawer, in the wash drum, or on laundered clothing. Prior art liquid unit dose laundry compositions have shortcomings with respect to meeting one or more of these stringent requirements.

One approach to improving solubility and/or to reducing residue is to decrease the level or remove completely from the liquid detergent formulation, the detergent ingredients that adversely affect solubility when they come into direct contact with the surrounding pouch material. Another approach is to formulate only very soluble and generic detergents, e.g., liquids entirely free from particulate matter and from challenging ingredients. Yet another solution is to focus on pouch materials, however this latter option restricts the possibility of using a wide variety of commercially available pouch materials.

WO01/79417 relates to a unit dose composition hindering the formation of lactones in pouch walls when these are made from a copolymer, by pH adjustment. EP 1 120 459 discloses a laundry detergent comprised of a substantially anhydrous isotropic liquid detergent formulation packaged in a water-soluble film, the liquid detergent comprising anionic surfactants and soap, and is said to be suitable for use when high foam levels are required. WO01/79416 relates to a water-soluble package in the form of a plastic envelope made by horizontal or vertical filling with a non-aqueous liquid detergent having a high or a low viscosity. U.S. Pat. No. 4,973,416 describes a clear, stable and isotropic aqueous liquid laundry detergent in a unit dosage form having an organic neutralization system, the detergent being formulated in a package comprising a water-soluble film-forming material.

As seen above, the pouched cleaning composition must be able to disintegrate quickly and completely in order to avoid residue being left in the drawer, in the wash drum or on the washed garments. Prior art compositions often do not dissolve as rapidly or as fully as desired. Furthermore the compositions known in the art do not effectively address the technical problem of how to make a liquid unit dose product for laundry, providing superior cleaning performance.

Hence, an object of the present invention is to provide pouched cleaning compositions that provide superior cleaning performance, demonstrate excellent dissolution and avoid residues. It has been found that some builder and chelants, i.e. builders/chelants free of $C_{8-22}$ alkyl or alkenyl chains, are essential to obtain such superior cleaning performance. However, such detergent ingredients may cause dissolution and residues problems. Therefore, it is an object of the present invention to provide a pouched cleaning composition incorporating builders and/or chelants, especially those that sequester transition metals in soils or wash-water for improved cleaning, while avoiding the dissolution and residues problems. Another object of the present invention is to provide a method to select the appropriate sequestrants and/or the appropriate physical forms under which they are suitable for use in pouched cleaning compositions.

It has now surprisingly been found that the pouched cleaning compositions of the present invention demonstrate better solubility and/or lower residues formation than do otherwise identical products wherein such sequestrants (builders/chelants free of $C_{8-22}$ alkyl or alkenyl chains) are soluble in the liquid composition. The compositions of the present invention also demonstrate better cleaning performance that otherwise identical products wherein such sequestrants have been removed or their levels greatly diminished.

SUMMARY OF THE INVENTION

The present invention relates to a pouched cleaning composition wherein the pouch is constructed from a water-soluble film and contains a liquid composition comprising:

(a) less than 5% by weight of the liquid composition, of water;

(b) an anionic surfactant;

(c) at least 0.5% by weight of the liquid composition of a builder/chelant free of C8–22 alkyl or alkenyl chains (herein referred to as sequestants); and is characterized in that less than 0.3%, preferably less than 0.2%, more preferably less than 0.1% by weight of the liquid composition, of said sequestrants is dissolved in said liquid composition.

The present invention further relates to a process for making a cleaning composition comprising:

(a) Formulating a liquid detergent with such a sequestrant being less than 0.3%, preferably less than 0.2%, more preferably less than 0.1% by weight of the liquid composition, soluble in said liquid composition; and (b) Incorporating such liquid detergent within a water-soluble pouch material.

Such process produces a pouched cleaning composition demonstrating good cleaning performance while preventing the pouch material from being insolubilized by the sequestrant.

The present invention also relates to the use of such sequestrants in a pouched cleaning composition for better cleaning performance and better solubility of the pouch while avoiding the formation of residues. The present invention also relates to methods of fabric treatment using such a composition.

The invention demonstrates improved cleaning as compared to otherwise identical compositions not having such sequestrants, and secures excellent low residue dissolution of the water-soluble pouches in automatic washing machines in the presence of heavy-duty liquid laundry detergent. This includes such dissolution at low wash temperatures (e.g., 5–30° C.) and/or low water levels (as in wool cycles or crease cycles) and/or short washing times (e.g., 5–50 min.) and/or in the presence of large amounts of laundry.

DETAILED DESCRIPTION OF THE INVENTION

The purpose of the present invention is to obtain concurrently (a) improved cleaning performance with a pouched built liquid laundry detergent, (b) without adversely affecting dissolution and/or dispersion, and/or avoiding residue-forming tendency of the pouch. This is accomplished by introducing a specific sequestrant in a phase-specific manner thereby controlling its interaction with the pouch water-soluble film as described below.

As defined herein below, improved cleaning performance is achieved by the addition of a builder/chelant free of C8–22 alkyl or alkenyl chains, herein referred to as "sequestrants". To avoid the dissolution and residues-forming problems that may occur when such sequestrants are used in a pouched cleaning composition, the present invention teaches that less than 0.3%, preferably less than 0.2%, more preferably less than 0.1% by weight of the liquid composition (expressed in acid from), of said sequestrants is dissolved in said liquid composition.

Indeed, the sequestrants of the present invention should be substantially insoluble in the liquid composition but soluble, i.e. water-soluble, in the wash solution.

The selection of the sequestrants to be used in the pouched cleaning compositions of the present invention is made according to the following solubility test:

Solubility Test (1) The liquid cleaning composition is prepared.

(2) The sequestrant free of C8–22 alkyl or alkenyl chains in whatever form is added to the liquid cleaning composition.

(3) The liquid cleaning composition is stored for 1 week at 20° C. to equilibrate.

(4) After equilibration, a sample of the liquid cleaning composition is centrifuged until there is full separation of the solids, i.e. the obtention of a clear top layer. The conditions of centrifugation depend on the nature of the liquid cleaning compositions and can be easily adapted by a person skilled in the art.

The concentration of the sequestrant is measured in the clear top layer via ionchromatography and quantified using reference materials with a known activity.

Methodology

Phosphonate compounds like 1,1-Hydroxyethylidene diphosphonate (HEDP) and diethylene triamine pentamethylene phosphonate (DTPMP) are separated by ion-chromatography and quantified using reference materials of known activity. This can be done using an Ion-Chromatography system equipped with eluent generator, conductivity detector and autosampler such as a Dionex DX-500 or equivalent by using an Ion chromatography column set Dionex IonPac AG11 4 mm guard (Part No. 44078) and Dionex IonPac AS 11-HC analytical column (Part No. 52960).

Sodium citrate can be analyzed by ion exclusion chromatography using a standard Waters HPLC unit equipped with a Biorad Amine HPX-87H column. An eluent containing 2.5 mN H2SO4 and 2.5% acetonitrile is used for separating the analyte (UV detection at 205 nm).

Remarks: If aminophosphonates are present, it is advisable to protect them from oxidation at the nitrogen moiety by adding sodium sulphite. Separation and quantitation of the chelants is improved by conditioning the system with regular injections of a strong DTPMP solution. This prevents loss of resolution caused by metal impurities.

EXAMPLE

A Heavy Duty Liquid formula (such as in the examples) comprising 1.24% by weight Hydroxy Ethylidene 1,1 Di Phosphonate Tetra Sodium salt ($Na_4$ HEDP), equivalent to 0.87% expressed as acid, and 3.1% by weight water as measured by Karl-Fischer titration, is prepared.

The composition is stored for 1 week at 20° C. to equilibrate. The product is then centrifugated until the solids are fully separated from the supernatant liquid phase. Typical conditions for centrifugation are 3 hours, at 15 000 rpm at 20° C. in a Beckman rotor JA-20. The clear supernatant liquid phase is then decanted.

The concentration of the sequestrant in the clear supernatant liquid phase is determined by separating the sequestrants via ion chromatography, and by quantifying them using reference materials with known activity. This is achieved in an Ion Chromatography system equipped with eluent generator, conductivity detector and autosampler, such as a Dionex DX-500 or equivalent, with a Dionex IonPac AG114 mm guard and Dionex IonPac AS11-HC analytical column.

In a first embodiment of the present invention, the sequestrant is selected from the list below using the solubility test described above, to have a solubility of less than 0.3% wt as such, in the liquid compositions. It has been found that the nature of the counter cation is a critical element in such selection. For example, a suitable sequestrant according to this first embodiment is the tetrasodium salt of hydroxy ethylidene 1,1 di phosphonic acid.

In a second embodiment of the present invention, a sequestrant from the list below is coated, encapsulated or agglomerated in solid particles. Such solid particle comprises the sequestrant and at least a binder substantially insoluble in the liquid cleaning composition such as to meet the solubility criteria of less than 0.3% wt in the liquid compositions. The term "binder" is defined as any material capable of reducing the solubility of the sequestrant below 0.3% wt in the liquid phase, by immobilizing such sequestrant into solid particle insoluble in the cleaning liquid compositions. Preferably such sequestrants can be at supracolloidal, e.g., visible or palpable particle sizes, for example by being incorporated into agglomerated particles having sizes as further discussed hereinafter.

It should be noted that immobilizing the sequestrants into solid particle (second embodiment) allows more flexibility in the choice of the sequestrants suitable for the purpose of the present invention. Sequestrants as such, i.e. added in the uncoated, non-encapsulated or non-agglomerate form can be found unsuitable as such for the first embodiment but may become suitable for the purpose of the present invention when coated, encapsulated or agglomerated with the appropriate binder as described in the second embodiment.

The Sequestrant

The cleaning compositions of the present invention comprise at least 0.5%, preferably from to 0.75% to 10%, more preferably from 1% to 5%, most preferably from 1.5% to 4% by weight of the liquid composition of a builder and/or chelant free of C8–22 alkyl or alkenyl chains (herein referred to as sequestrant). Indeed such sequestrants are known to be very effective in stain removal—especially tea, wine, coffee, fruit and vegetable juices stains removal; in soil suspension and in overall cleaning; and their presence in cleaning composition is a real advantage.

The composition of the present invention comprise less than 0.3%, preferably less than 0.2%, more preferably less than 0.1% by weight of the liquid composition, of sequestrant, soluble in the liquid composition. Sequestrant levels are expressed on the basis of the acid form.

Sequestrants as defined herein do not include, for example, insoluble ion exchangers such as zeolites, filler salts such as sodium sulphate, or sodium carbonate. These materials can be used as process aids or agglomerating aids in compositions of the invention but not as the sequestrant.

Suitable sequestrants for the purpose of the present invention include citrate, itaconate, iminodisuccinate, 2,2'-oxydisuccinate, nitrilotriacetate, carboxymethyloxysuccinate, aspartate, tartrate monosuccinate, tartrate disuccinate, aminophosphonates, phosphonates, ethylenediaminedisuccinates, and the like, or mixtures thereof, in any suitable water-soluble form.

Sequestrants can include those which bind only calcium and/or magnesium, or those having binding constants for transition metals which greatly exceed their binding constants for calcium and/or magnesium.

Further suitable sequestrants include water soluble polyelectrolyte types such as polyaspartate or the like.

Further suitable compounds are the sequestrants having two or more phosphonic acid or phosphonate groups, or two or more carboxylic acid or carboxylate groups, or mixtures thereof.

Other suitable sequestrants for use herein include nitrilotriacetic acid and polyaminocarboxylic acids such as ethylenediamine tetra acetic acid, ethylenetriamine penta acetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Suitable sequestrants with two or more carboxylates or carboxylic acid groups include the acid or salt forms of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Sequestrants containing three carboxy groups include, in particular, the acids or salt forms of citrates, itaconates and citraconates as well as succinate derivatives. Preferred carboxylate sequestrants are hydroxycarboxylates containing up to three carboxy groups per molecule, more particularly citrates and citric acids. Of course for best cleaning results, it is significantly preferred to employ sequestrants with at least a series of calcium binding constants equal to the averaged calcium binding constants of citrate, in this regard it is well-known that salts such as succinate or fumarate are not very effective.

Sequestrants containing four carboxy groups include the salts and acid forms of oxydisuccinates, 1,1,2,2-ethane tetracarboxylates, 1,1,3,3-propane tetracarboxylates and 1,1,2,3-propane tetracarboxylates, sulfosuccinate derivatives. Cyclic and aromatic tri- or tetra-carboxylates can also be used.

Highly suitable organic phosphonates herein are amino alkylene poly (alkylene phosphonates), alkali metal ethane 1-hydroxy bisphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylidene 1,1 diphosphonate.

Most preferred sequestrant for the first embodiment is the tetrasodium salt of hydroxy ethylidene 1,1 di phosphonic acid. Most preferred sequestrants for the second embodiment are tetrasodium salt of hydroxy ethylidene 1,1 di phosphonic acid and/or trisodium salt of citrate.

The sequestrants are preferably in the fully neutralized or salt form, however, the acid form or partially neutralized forms are encompassed in the invention. The preferred form of sequestrant is fully neutralized with alkali metal as the counter-ion. Highly preferred as the charge-balancing, or counter-ion of the sequestrant is sodium. Potassium or lithium salt forms may also be used but the potassium salts are frequently more hygroscopic and lithium salts may present other problems for detergent formulation such as cost. Ammonium alkanolammonium salts may also be used but are not preferred. Adventitious amounts of other charge-balancing ions including varying proportions of calcium and/or magnesium can be present, depending on the synthetic route of the sequestrant and the quality of supply. These divalent or polyvalent ions will not normally be added, for best cleaning results.

Moreover it is preferred for handling reasons to use as sequestrants those materials which are available in crystalline and relatively nonhygroscopic form, such as citrate or HEDP; some sequestrants, for example the triphosphonates, are sometimes in the form of dusty and relatively hygroscopic powders, such forms are less preferred. Alternatively when using the most hygroscopic and/or dusty forms of the sequestrants, it is preferred to employ the second embodiment of the invention such as the substantially complete coatings thereof.

Second Embodiment

In a second embodiment, any of the sequestrants described hereinabove are coated, encapsulated or agglomerated in solid particles. Such solid particle comprise the sequestrant and at least a binder substantially insoluble in the liquid cleaning composition such as to meet the solubility criteria of less than 0.3% wt in the liquid compositions. Preferred for the purpose of the second embodiment of the present invention is the coating, encapsulation or agglomeration of the sequestrant with PEG 4000–8000, preferably PEG 8000.

Coating, encapsulation, agglomeration can be achieved using well-known particle making techniques such as agglomeration which increase the size of the sequestrant-containing particles from a starting-point which can be sub-colloidal or simply powdery, and may partially include the provision of an additional material, such as a waxy binder and/or other process aid to assist processing and/or further at least partially to isolate the sequestrant from the liquid detergent and/or from the pouch material.

In a first alternative, the agglomerates simply contain the sequestrant without any need to provide a complete or perfect coating or encapsulation. Such particles can simply be made by agglomerating the sequestrant, for example with a substance which is insoluble or limitedly soluble in the liquid detergent prior to dilution in the wash, preferably a waxy but somewhat hydrophilic substance such as PEG 4000–8000, optionally with an agglomerating aid or promoter such as a limited amount of an insoluble crystalline inorganic powder, e.g., a zeolite. Any other suitable coating material can be used, for example cellulose derivatives such as hydroxypropylmethylcellulose.

In another alternative, the sequestrant is fully encapsulated or coated using any known encapsulation technique. Ratios of sequestrant to agglomerating agent and/or the choice or agglomerating agent or encapsulant can vary widely, suitable ratios minimize the amount of agglomerating agent and/or encapsulant, e.g., having no more than about half of the combination by weight, preferably no more than about 40% of the combination, preferably less, e.g., 25% or a lower amount, as agglomerant and/or encapsulant. Additional materials can be used in processing, including for example any known solid binders or agglomeration initiators.

One preferred manner of this process in which to ensure that the solid particles of sequestrant do not dissolve is to decrease their surface area. Thus it is preferred to use sequestrant in solid form at supracolloidal particle sizes, e.g., above about 1 micron, more preferably above 10 microns, more preferably still above 50 microns, e.g., from 50 microns to 4 millimeters, more typically 50 microns to 1 millimeter. Thus it is preferred to use sequestrant in solid form at supracolloidal particle sizes and at the same time in the form of an agglomerate or extrudate.

In more details, one suitable approach is to embed the sequestrants in solid particles, and to add the sequestrant-containing particles to the liquid detergent. Suitable particles are composed of one or more of several sequestrants, together with a suitable binder and/or coating agent and/or agglomeration promter. One suitable binder is a water-soluble polymer which in general can be insoluble or partially soluble in the liquid detergent prior to dilution of the detergent in a wash bath. A suitable binder is polyethylene glycol (abbreviation PEG) of molecular weight in the 2000–10000 range, preferably from 4000 to 8000 daltons. Other water-soluble polymers such as starches, carboxymethylcellulose, biopolymers, sugars can be used especially when they are soluble in water and insoluble in the liquid detergent. The particles can be made by any suitable process including agglomeration, coating, extrusion, or the like. The particle size can range from 5 microns up to 1 millimeter, preferably from 50 microns to 700 microns, more preferably from 100 microns up to 600 microns. Optionally, the particles can contain other ingredients such as detergent actives (e.g. brighteners) or aesthetics (dyes or pigments, including titanium dioxide if a white color is desired).

In general, the sequestrant can be combined with any other ingredient suitable for making laundry detergents, especially solid-form laundry detergents. This includes all the ingredients known from the tablet-making (including disintegrants), detergent agglomerate-making, and detergent powder making arts. It is quite helpful to combine the sequestrant with materials known to facilitate commercial particle-making for detergents. The sequestrant can also be combined into a single particle with any benefit agent known for cleaning or fabric care use in laundry detergents.

If commercially provided as a solution, the sequestrant is dried down by any suitable technique such as single- or multi-stage spray drying, drum drying, freeze drying or the like, to form a solid. This solid can have any particle size or morphology. In some cases it may be desirable to initiate crystallization of the sequestrant using seed crystals of the same material, before or during the drying step. Most commonly, the sequestrant is commercially available in solid form, e.g., as a powder.

The particles can be added directly to the liquid detergent in any mixing order. For example a portion of the detergent and the particles can be mixed to form a pumpable slurry forming one feed for the pouch filling line; this slurry can be further mixed with a major liquid detergent stream in any appropriate ratio before or during the pouch-filling step.

More typically, when working with a sequestrant in powder form, best results are achieved by processing the powdered sequestrant with any suitable additive, for example one which facilitates the making of an agglomerate.

Suitable agglomerating techniques are well known in the field of granular detergents.

Encapsulates, extrudates, marumes, prills and any other particle form of the sequestrant are fully within the variations possible. Thus it is within the scope of the invention to reapply all the known particle-making techniques, for example marumes using processes similar to those used for making enzymes, or extrudates as known for making other kinds of detergent ingredient, such as bleaches. Likewise the techniques known for speckle-making (aesthetic particle making) are useful herein.

Particle making can be done in the presence of specific optional adjuncts, for example for any aesthetic purpose such as to adjust the color, whiteness, brightness, odor or refractive index of the particle.

Particles herein can have any suitable morphology, including blocks, rods, spheres, and oblate or regular shapes of any kind and having whatever symmetry or aspect ratio. In general simple shapes presenting relatively low surface area to the liquid detergent are preferred.

The Pouch

The pouch herein is typically a closed structure, made of materials described herein, enclosing a volume space. The pouch comprises a composition which can be in any suitable liquid form as described below. The term "pouch" herein accordingly connotes a type of encapsulation or containment which is readily distinguishable from microencapsulates, gel-caps, bath beads and the like.

The pouch and volume space thereof, can be of any form, shape and material which is suitable to hold the composition, e.g. without allowing the release of the composition from the pouch prior to contact of the pouch to water. The exact execution will depend on for example the type and amount of the composition in the pouch, the number of compartments in the pouch, the characteristics required from the pouch to hold, protect and deliver or release the compositions. Preferably, the pouch has a spheroid shape. Preferably the composition of the present invention is contained in an inner volume space of a single closed pouch, the pouch being as described hereinafter; or it may be divided over one or more compartments of a multi-compartment pouch.

The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

The pouch herein can also comprise multiple compartments containing any combination of detergent compositions. If the pouch comprises multiple compartments they will typically be closed structures made of a water-soluble film which encloses a volume space which comprises the components of the detergent composition. Said volume space is preferably enclosed by a water-soluble film in such a manner that the volume space is separated from the outside environment.

Water-Reactive Film

The pouch is typically made from a water-soluble film. It is preferred that the pouch as a whole comprises material which is water-dispersible or more preferably water-soluble. Preferred water-soluble films are polymeric materials, preferably polymers which are formed into a film. The material in the form of a film can for example be obtained by solution casting, extrusion casting or extrusion blowing of the polymer material, as known in the art.

The water-soluble films for use herein typically have a solubility in water of at least 50%, preferably at least 75% or even at least 95%, as measured by the method set out hereinafter using a glass-filter with a maximum pore size of 50 microns using the following gravimetric method for determining water-solubility of the material of the compartment and/or pouch:

50 grams±0.1 gram of material is added in a 400 ml beaker, whereof the weight has been determined, and 245 ml±1 ml of distilled water is added. This is stirred vigorously on magnetic stirrer set at 600 rpm, for 30 minutes at 20° C. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the percentage solubility or dispersability can be calculated. The water soluble film and preferably the pouch as a whole is stretched during formation and/or closing of the pouch, such that the resulting pouch is at least partially stretched. This is to reduce the amount of film required to enclose the volume space of the pouch decreases.

The film preferably has a thickness of from 1 μm to 200 μm, more preferably from 15 μm to 150 μm, even more preferably from 30 μm to 100 μm.

Preferred polymer copolymers or derivatives thereof are selected from polyvinyl alcohol (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum; and/or mixtures thereof. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates; and/or mixtures thereof. Most prefered are polyvinyl alcohols, polyvinyl alcohol copolymers and hydroxypropyl methyl cellulose (HPMC). Preferably, the level of polymer in the film, for example a PVA polymer, is at least 60%.

The polymer can have any weight average molecular weight, preferably from about 1000 to 1,000,000, or even form 10,000 to 300,000 or even form 15,000 to 200,000 or even form 20,000 to 150,000 daltons.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000 to 40,000, preferably around 20,000, and of PVA or copolymer thereof, with a weight average molecular weight of about 100,000 to 300,000, preferably around 150,000 daltons.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-dispersible, or water-soluble.

It may be preferred that the polymer present in the film is from 60–98% hydrolysed, preferably 80% to 90%, to improve the dissolution of the film.

Most preferred films are films which comprise a PVA polymer with similar properties to the film which comprises a PVA polymer and is known under the trade reference M8630, as sold by Monosol. Another preferred film is known under the trade reference PT-75, sold by Aicello Chemical Europe GmbH, Carl-Zeiss-Strasse 43, 47445 Moers, DE.

The film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful when the composition herein is a detergent composition, that the film itself comprises a detergent additive to be delivered to the wash water, for example organic polymeric soil release agents, dispersants, dye transfer inhibitors.

The Liquid Composition

Compositions for use in the present invention are fabric cleaning compositions and fabric care compositions. Compositions for use in the present invention can also, include any pre-treatment or soaking composition or other laundry rinse additive composition consistent with the spirit and scope of the invention.

Unless stated otherwise all percentages herein are weight percent of the final composition excluding the film.

If the pouch has multiple compartments the compartments may contain any combination of detergent compositions.

The liquid composition comprises less than 5% by weight water, preferably less than 4%, more preferably less than 2%, less than 1% even more preferably less than 0.5% by weight of the composition, as determined by Karl Fischer Method. For one group of preferred compositions, all materials destined to form part of the liquid detergent are selected to have no water or the practical minimum. For online process control purposes in a manufacturing facility, other methods, such as conductivity, nmr and the like can be used. Compositions herein are prepared using strict quality control measures to avoid accidental ingress of moisture into the process. A suitable Karl Fischer method is given in U.S. Pat. No. 6,207,634 including the separation of particulate matter by centrifugation before K-F determination of the liquid which is a preferred method herein. However the art is replete with discussion of parameters affecting Karl Fischer moisture determinations and the practitioner may adapt in accordance with the art, e.g., by use of AOCS methods such as AOCS(1993)Ca 2e-84 or the methods available online from the Joint FAO/WHO Committee on Food Additives including residual titration and advice therein concerning both accuracy and precision.

The liquid detergent composition can be made by any method and can have any viscosity, typically depending on its ingredients. The term "liquid' as used in this context should not be considered to exclude even pasty or flowable gel forms. The liquid detergent composition preferably has a viscosity of 50 to 10000 mPas, as measured at a rate of 20 $s^{-1}$, more preferably from 200 to 3000 mPas or even from 300 to 600 mPas. The compositions herein can be Newtonian or non-Newtonian. The viscosity may further be controlled or modified, if desired, by using various viscosity modifiers such as hydrogenated castor oil and/or hydrotropes and/or organic solvents. Hydrogenated castor oil is commercially available as Thixcin®. The liquid composition preferably has a density of 0.8 kg/l to 1.3 kg/l, preferably around 1.0 to 1.1 kg/l. The liquid compositions contain particles, nominally suspended in the liquid, however in general, and surprisingly, stability of suspension is not essential. The particles can even be permitted to sink onto, or float onto, and touch the pouch material. In preferred embodiments, stable suspensions are included, for example when using a hydrogenated castor oil or organogelant for control of rheology of the liquid. In general the liquid detergents herein can be internally or externally structured, or can be unstructured as described in Surfactant Science Series, vol. 67, Liquid Detergents, M. Dekker, NY, 1997; see also WO02/02730A1 for a recent discussion of structuring particularly focused on surfactant structuring. Preferred compositions herein specifically include externally structured types.

Liquid detergents herein are "built" in the sense that they contain a sequestrant as defined hereinabove, preferably a sequestrant in combination with a fatty acid builder. Builder/hardness ratios for the present compositions can vary widely since dosage can vary in use as can the water hardness and soil level of the laundry. Heavy-Duty Liquid detergents, suitable ingredients for such detergents, and literature including patent references are extensively included in Surfactant Science Series, Volume 67, "Liquid Detergents", Ed.

Kuo-Yann Lai, Marcel Dekker, Basel, 1997, ISBN 0-8247-9391-9; see in particular Chapter 8 "Heavy Duty Liquid Detergents" at pp 261–324 and references therein.

Anionic Surfactant

The compositions of the invention comprise an anionic surfactant, preferably at least a sulphonic acid surfactant, such as a linear alkyl benzene sulphonic acid, but water-soluble salt forms may also be used. Anionic surfactant(s) are typically present at a level of from 7.5% to 70%, preferably from 10% to 60% by weight, more preferably from 15% to 35% by weight of the liquid composition.

Anionic sulfonate or sulfonic acid surfactants suitable for use herein include the acid and salt forms of C5–C20, more preferably C10–C16, more preferably C11–C13 alkylbenzene sulfonates, C5–C20 alkyl ester sulfonates, C6–C22 primary or secondary alkane sulfonates, C5–C20 sulfonated polycarboxylic acids, and any mixtures thereof, but preferably C11–C13 alkylbenzene sulfonates.

Anionic sulphate salts or acids surfactants suitable for use in the compositions of the invention include the primary and secondary alkyl sulphates, having a linear or branched alkyl or alkenyl moiety having from 9 to 22 carbon atoms or more preferably 12 to 18 carbon atoms.

Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the C5–C22, preferably C10–C20 mid-chain branched alkyl primary sulphates. When mixtures are used, a suitable average total number of carbon atoms for the alkyl moieties is preferably within the range of from greater than 14.5 to about 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl ethyoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium. Preferably, the anionic surfactants are neutralized with alkanolamines such as Mono Ethanol Amine or Triethanolamine, and are fully soluble in the liquid phase.

Fatty Acid Builder

The liquid composition of the present invention will preferably further comprise a fatty acid builder typically present at a level of from 0.5% to 60% by weight, preferably from 13% to 20% by weight. Preferred are high solubility fatty acid mixtures.

Preferred are in particular $C_{12}$–$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$–$C_{18}$ topped whole cut fatty acids, or a mixture of rape seed-derived fatty acid and a tallow alcohol derived fatty acid, palmitic, oleic, fatty alkylsuccinic acids, and mixtures thereof. Further preferred are branched fatty acids of synthetic or natural origin, especially biodegradable branched types.

Mixtures of any of these fatty acid builders can be advantageous to further promote solubility. It is known that lower chain length fatty acids promote solubility but this needs to be balanced with the knowledge that they are often malodorous, e.g., at chain lengths of C9 and below.

While the term "fatty acid builder" is in common use, it should be understood and appreciated that as formulated in the present detergents, the fatty acid is in at least partially neutralized to neutralized form, the counter-ions can typically be alkanolamines, sodium, potassium, alkanolammonium or mixtures thereof. Preferably, the fatty acids are neutralized with alkanolamines such as Mono Ethanol Amine, and are fully soluble in the liquid phase.

Solvents

The term "solvent" for formula accounting purposes herein does not include water. Suitable solvents for use in the present composition include monohydric alcohols, dihydric alcohols, polyhydric alcohols, glycerol, glycols, polyalkylene glycols such as polyethylene glycol, and mixtures thereof. Highly preferred are mixtures of solvents, especially mixtures of lower aliphatic alcohols such as ethanol and/or diols such as 1,2-propanediol or 1,3-propanediol; or mixtures thereof with glycerol. Suitable alcohols especially include a $C_1$–$C_4$ alcohol. Preferred is 1,2-propanediol. In practice when using alcohol or diol solvents, reasonable precautions are taken to avoid contamination of these solvents with water; for example, the solvent is not permitted to equilibrate with moist air (dry alcohols are hygroscopic) and washouts of storage vessels with water are followed by drying and/or solvent flushing.

Other suitable solvents include a wide variety of hydrocarbons, ethers, ketones, glycol ethers, other lower polyhydric alcohols and the like. The solvent may be protic or aprotic and polar or nonpolar. Amines and alkanolamines may likewise be used, however for formula accounting purposes any solvent which can form a salt with an anionic component is reckoned as a pH adjuster.

The compositions of the invention are preferably concentrated liquids having preferably less than 50% or even less than 40% by weight of solvent, preferably less than 30% or even less than 20%. Solvent-free embodiments are not excluded. Preferably the solvent is present at a level of at least 5% or even at least 10% or even at least 15% by weight of the composition. Some non-zero amount of non-water solvent is believed to be advantageous for the working of the invention, for example by moderaring the polarity or diminishing the salt-carrying ability of any water present.

pH Adjusters

Amines, alkanolamines such as monoethanolamine, diethanolamine and the like can be used as pH adjusters; as can other simple acids or bases. Any suitable amount can be used to arrive at the typical pH range, from near neutral to alkaline, of common heavy duty liquid detergents. Higher pH, e.g, 10.5 or above, favors cleaning but may create other problems such as in enzyme stability.

Rheology Control Agents

Preferably the liquid composition of the present invention will further comprise a rheology control agent. Any suitable rheology control agent can be used herein, whether to structure the liquid detergent internally or externally. The rheology control agent may be soluble or insoluble, or can be initially soluble at the making temperature of the liquid detergent and then crystallize in it at subcolloidal (nanoparticulate) or colloidal size ranges. The rheology control agent can be organic or inorganic, preferably organic, and can operate via any known mechanism, for example one involving hydrogen bonding when some water is present. Surprisingly certain of the more recent types as exemplified below can operate satisfactorily at least partially via H-bonding even in the instant low water detergents. Alternately rheology control agents useful herein can operate by other mechanisms, for example one involving only non-hydrogen bonding forces, such as dispersion forces, for example when no water is present or where the liquid detergent is substantially nonaqueous, or another mechanism such as one involving pi-bonding interactions may be involved. The terms "organogelant", "organogelator", "gelator" and the acronym LMOG have been used in the recent technical literature to refer to important classes of such materials which it is here determined are useful in the context of the present invention and more generally in heavy-duty liquid laundry detergents. Such materials include for example those carbamates which are readily produced by the reaction of carbon dioxide with fatty secondary amines comprising two C10–C22 saturated hydrocarbyl chains and an N—H group. See J. Amer. Chem. Soc., 2001, 123, 10393–10394 and more generally for other suitable compounds, the references cited therein, especially the references to Abdallah and Weiss, B. L. Feringa and others. In use the LMOG's aggregate into specific fibers, strands, tapes and so forth to form unique types of networks. Degree of immobilization of the liquid component can be varied so that thickened low viscosity liquids as well as stiffer gels or pastes are accessible. Also suitable herein are preformed subcolloidal, colloidal or fine particulate salts of alkylbenzenesulfonates or of long-chain alkylsulfates; hydrogenated castor oil, e.g., trihydroxystearin can simply and preferably be used; as can ultra-long chain saturated straight-chain hydrocarbons, e.g., those having carbon chains of from 20 to 60 carbon atoms; lecithins such as soya bean lecithin (see for example J. Phys. Chem. B 2001. 105, 10484–10488) and biopolymers such as the common or rarer gums or sugar derivatives can also be used. It should however be understood and appreciated that rheology control agents suitable for low water content products are preferred. The rheology control agent can be one which produces a clear mixture, an opalescent or Tyndall scattering mixture, a pearlescent mixture, or a wholly opaque mixture in a low water-content detergent having no other dispersed solids. Preferred rheology control agents also include those having a low or negligible tendency to deposit or build up on textiles, though in view of the very low use levels of some of the more recently developed materials, they may be surprisingly problem-free in this regard. Rheology control agents subject to recrystallizing on storage to larger particle sizes can if desired be complemented by crystal growth modifiers to limit such tendency. Rheology control agents can be used in mixtures and at any known level, such as from about 0.0001% to about 30%, preferably 0.001% to about 10%, more typically 0.01% to about 5%, suitably for some applications up to 2% of the composition. Very low weight levels in the indicated ranges are suitable especially when forming a structuring system not requiring great stiffness and with a nanosized rheology control agent, more particularly one which has a low tendency to ripening of the network on storage. Rheology control agents when used as formulation ingredients at levels which can be changed independently from the surfactant levels in the composition offer significant advantages for the formulator of liquid laundry detergents, in that their use provides a tunability of rheology entirely dependent of the cleaning surfactants, leading to important economies and flexibility of production, indeed a plurality of different apparent product forms for the detergent. However rheology control agents can also be combined, if desired, with any of the known internal surfactant structuring systems. Moreover the present rheology control agents can have additional important uses, such as at low levels to stabilize emulsions of benefit agents having liquid form, e.g., for fabric care, in heavy-duty liquid detergents. Preferred are hydrogenated castor oil; ultra-long chain saturated straight-chain hydrocarbons, organogelants and/or mixtures thereof.

Hydrotropes

One further highly preferred optional ingredient is a hydrotrope. It has been found that the inclusion of a hydrotrope in the present pouch compositions can further improve dissolution. In a more traditional definition, a hydrotrope is a substance with the ability to increase the solubility of certain slightly soluble organic compounds. More recently the term has been used to refer to relatively low molecular weight organic compounds that tend to thin viscous surfactant phases. The above-defined rheology control agents and the hydrotropes may therefore appear to operate with contradictory effect, which can nonetheless be useful to arrive at a wide range of rheology. A description of hydrotropes for use herein can be found in Surfactant Science, Vol. 67 "Liquid Detergents", 1997 in Chapter 2 entitled "Hydrotropy".

Preferably when a hydrotrope is present, the compositions herein comprise from 0.01% to 15%, more preferably from 0.1% to 10%, even more preferably from 0.25% to 7%, even more preferably still from 0.5% to 5%, by weight of composition, of hydrotrope.

Preferred hydrotropes are selected from sodium cumene sulphonate, sodium xylene sulphonate, sodium naphthalene sulphonate, sodium p-toluene sulphonate, $C_5$–$C_{20}$ polyols and mixtures thereof. Especially preferred is sodium cumene sulphonate. While the sodium form of the hydrotrope is preferred, the potassium, ammonium, alkanolammonium, and/or $C_2$–$C_4$ alkyl substituted ammonium forms can also be used.

The preferred $C_5$–$C_{20}$ polyols are those wherein at least two polar groups are separated from each other by at least 5, preferably 6, carbon atoms. Preferably, the polyols of the present invention have from 5 to 12, more preferably from 5 to 10, even more preferably from 6 to 8, carbon atoms.

Examples of suitable polar groups for inclusion in the $C_5$–$C_{20}$ polyols include are hydroxyl and carboxyl ions. Preferably the polyols of the present invention have from 2 to 6, more preferably from 2 to 4, even more preferably 2, hydroxy groups per molecule.

Particularly preferred $C_5$–$C_{20}$ polyols include 1,4 cyclohexanedimethanol, 1,6 Hexanediol and 1,7 Heptanediol. Highly preferred is 1,4 Cyclo Hexane Di Methanol. Mixtures of these organic molecules or any number of $C_5$–$C_{20}$ polyols which comprise two polar groups separated from each other by at least 5, preferably 6, aliphatic carbon atoms are also acceptable. 1,4 Cyclo Hexane Di Methanol may be present in either its cis configuration, its trans configuration or a mixture of both configurations.

For the avoidance of doubt, any liquid low molecular weight compound present at levels in excess of 0.1% of formula and not being in the specifically named hydrotropes above will for formula accounting purposes be included in the hereinbefore defined solvent component.

Cosurfactant

The detergent compositions of the invention can comprise simply a single anionic surfactant such as linear alkylbenzenesulphonate (the commercial forms including many different isomers as a mixture and being available in the so-called low-2-phenyl or high-2-phenyl varieties) or it can additionally comprise one or more other cosurfactants. Suitable cosurfactants include nonionic, anionic, amphoteric or zwitterionic, and cationic surfactants.

Preferably, at least 10%, more preferably at least 15%, even more preferably at least 20%, by weight of the composition is a surfactant, preferably less than 70%, more preferably less than 60%, even more preferably less than 50%, by weight of compositions is surfactant.

When using a cosurfactant, a preferred combination comprises an anionic surfactant and a nonionic surfactant, suitably at a weight ratio of 10:1 to 1:10, preferably 5:1 to 1:2, more preferably 1.5:1 to 1:1.5. Suitable nonionic surfactants useful as cosurfactant include the nonionic alkoxylated types, as further described hereinafter.

Nonionic Surfactant

Essentially any alkoxylated nonionic surfactant, suitably one containing only carbon, hydrogen and oxygen can be included in the present compositions, although amidofunctional and other heteroatom-functional types can in general also be used. Ethoxylated, propoxylated, butoxylated or mixed alkoxylated, for example ethoxylated/propoxylated aliphatic or aromatic hydrocarbyl chain nonionic surfactants are preferred. Suitable hydrocarbyl moieties can contain from 6 to 22 carbon atoms and can be linear, branched, cycloaliphatic or aromatic and the nonionic surfactant can be derived from a primary or secondary alcohol.

Preferred alkoxylated surfactants can be selected from the classes of the nonionic condensates of ethoxylated and ethoxylated/propoxylated or propoxylated/ethoxylated linear or lightly branched monohydric aliphatic alcohols, which can be natural or synthetic. Alkylphenyl alkoxylates such as the nonylphenyl ethoxylates can also suitably be used.

Especially suitable as nonionic surfactant or cosurfactant are the condensation products of primary aliphatic alcohols with from 1 to 75 moles of $C_2$–$C_3$ alkylene oxide, more suitably 1 to 15 moles, preferably 1 to 11 moles. Particularly preferred are the condensation products of alcohols having an alkyl group containing from 8 to 20 carbon atoms with from 2 to 9 moles and in particular 3 or 5 moles, of ethylene oxide per mole of alcohol.

Suitable nonionic surfactants containing nitrogen as heteroatom include the polyhydroxy fatty amides having the structural formula $R^1CONR^2Z$ wherein $R^1$ is a $C_5$–$C_{31}$ hydrocarbyl, preferably straight-chain $C_7$–$C_{19}$ alkyl or alkenyl, more preferably straight-chain $C_{11}$–$C_{17}$ alkyl or alkenyl, or mixture thereof; $R^2$ is H, $C_{1-18}$, preferably $C_1$–$C_4$ hydrocarbyl, 2-hydroxethyl, 2-hydroxypropyl, ethoxy, propoxy, or a mixture thereof, preferably $C_1$–$C_4$ alkyl, more preferably methyl; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar such as glucose, a corresponding preferred compound being a $C_{11}$–$C_{17}$ alkyl N-methyl glucamide.

Other nonionic surfactants useful herein include the so-called "capped" nonionics in which one or more —OH moieties are replaced by —OR wherein R is typically lower alkyl such as C1–C3 alkyl; the long-chain alkyl polysaccharides, more particularly the polyglycoside and/or oligosaccharide type, as well as nonionic surfactants derivable by esterifying fatty acids.

Cationic Surfactant

Suitable cationic cosurfactants include cationic monoalkoxylated and bis-alkoxylated quaternary amine surfactants containing a single long ($C_6$–$C_{18}$) N-alkyl chain, such as compounds of the general formula $R^1R^2R^3N^+(A_pR^4)X^-$ wherein $R^1$ is an alkyl or alkenyl moiety containing from 6 to about 18 carbon atoms, more preferably from about 6 to about 14 carbon atoms; $R^2$ and $R^3$ are each independently alkyl groups containing from one to three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulphate, sulphate, or the like, to provide electrical neutrality; A is an alkoxy group, especially a ethoxy, propoxy or butoxy group; and p is from 0 to about 30, preferably 2 to about 15, most preferably 2 to about 8.

Other suitable cationic surfactants include cationic bis-alkoxylated amines preferably having the general formula $R^1R^2N^+(A_pR^3)(A_qR^4)X^-$ wherein $R^1$ is an alkyl or alkenyl moiety containing from 8 to 18 carbon atoms, preferably 10 to 16 carbon atoms, most preferably from 10 to 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulphate, sulphate, or the like, sufficient to provide electrical neutrality. A and A' can vary independently and are each selected from C1–C4 alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Another suitable group of cationic surfactants are cationic ester surfactants. Suitable cationic ester surfactants, including choline ester surfactants, have for example been disclosed in U.S. Pat. Nos. 4,228,042, 4,239,660 and 4,260,529.

Bleaching Agent

Another ingredient which may be present is a perhydrate bleach, such as salts of percarbonates, particularly the sodium salts, and/or organic peroxyacid bleach precursors, and/or transition metal bleach catalysts, especially those comprising Mn or Fe and/or preformed peracids and/or oxygen bleach boosters.

When the pouch or compartment is formed from a material having free hydroxy groups, such as PVA, then perhydrates other than those containing boron should be used in preference over perborate salts or borate salts since these latter materials interact with hydroxy-containing pouch polymers and reduce their dissolution and/or harm detergent performance.

Boron-free inorganic perhydrate salts are thus a preferred source of peroxide. Examples of inorganic perhydrate salts include percarbonate, perphosphate, the persulfates and persilicate salts. The inorganic perhydrate salts are normally the alkali metal salts. Alkali metal percarbonates, particularly sodium percarbonate are preferred perhydrates herein.

The composition herein suitably also comprises a peroxy acid or a precursor therefor (bleach activator). It may be preferred that the composition comprises at least two peroxy acid bleach precursors, preferably at least one hydrophobic peroxyacid bleach precursor and at least one hydrophilic peroxy acid bleach precursor. The production of the organic peroxyacid occurs by an in-situ reaction of the precursor with a source of hydrogen peroxide such as a perhydrate, hydrogen peroxide itself, or hydrogen peroxide generated in-situ from another source. The hydrophobic peroxy acid bleach precursor preferably comprises a compound having a oxy-benzene sulphonate group, preferably NOBS, DOBS, LOBS and/or NACA-OBS. The hydrophilic peroxy acid bleach precursor preferably comprises TAED. Other much more weakly perhhydrolyzing precursors include triacetin.

Amide substituted alkyl peroxyacid precursor compounds can be used herein. Suitable amide substituted bleach activator compounds are described in EP-A-0170386.

The composition may contain a pre-formed organic peroxyacid. A preferred class of organic peroxyacid compounds are described in EP-A-170,386. Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxycaproic acid are also suitable herein.

Suds Suppressing System

Suitable suds suppressing systems for use herein may comprise essentially any known antifoam compound or mixture, typically at a level less than 10%, preferably 0.001% to 10%, preferably from 0.01% to 8%, most preferably from 0.05% to 5%, by weight of the composition.

Suitable suds suppressors can include low solubility components such as highly crystalline waxes and/or hydrogenated fatty acids, silicones, silicone/silica mixtures, or more sophisticated compounded suds suppressor combinations, for example those commercially available from companies such as Dow Corning. Compounded silicones are suitably used at levels of 0.005% to 0.5% by weight. More soluble antifoams include for example the lower 2-alkyl alkanols such as 2-methyl-butanol.

Enzymes

Suitable enzymes include enzymes selected from peroxidases, proteases, glucoamylases, amylases, xylanases, cellulases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, dextranase, transferase, laccase, mannanase, xyloglucanases, or mixtures thereof. Detergent compositions generally comprise a cocktail of conventional applicable enzymes like protease, amylase, cellulase, lipase.

Enzymes are generally incorporated in detergent compositions at a level of from 0.0001% to 2%, preferably from 0.001% to 0.2%, more preferably from 0.005% to 0.1% pure enzyme by weight of the composition.

Suitable proteases are the subtilisins which are obtained from particular strains of *B. subtilis, B. licheniformis* and *B. amyloliquefaciens* (subtilisin BPN and BPN'), *B. alcalophilus* and *B. lentus*. Suitable Bacillus protease is Esperease®) with maximum activity at pH 8–12, sold by Novozymes and described with its analogues in GB 1,243,784. Other suitable proteases include Alcalase®, Everlase® and Savinase® from Novozymes. Proteolytic enzymes also encompass modified bacterial serine proteases, such as those described in EP 251 446 (particularly pages 17, 24 and 98), referred to as "Protease B", and in EP 199 404 which refers to a modified enzyme referred to as "Protease A". Also suitable is the enzyme called "Protease C", which is a variant of an alkaline serine protease from Bacillus (WO 91/06637). A preferred protease referred to as "Protease D" is a carbonyl hydrolase variant having an amino acid sequence not found in nature, described in WO95/10591 and WO95/10592. Preferred proteases are multiply-substituted protease variants comprising a substitution of an amino acid residue at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin. WO 99/20723, WO99/20726, WO99/20727, WO99/20769, WO99/20770 and WO99/20771 describe also suitable proteases, wherein preferred variants have the amino acid substitution set 101/103/104/159/232/236/245/248/252, more preferably 101 G/103A/1041/159D/232V/236H/245R/248D/252K according to the BPN' numbering.

Amylases (α and/or β) can be included for removal of carbohydrate-based stains. Suitable amylases are described in WO94/02597 and WO95/10603 (both Novozymes). WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable variants of the above enzymes are described in WO96/23873 (Novozymes). Preferred variants therein are those with increased thermostability described on p16 of WO96/23873, and especially the D183*+G184*. Examples of commercial α-amylases products are Purafect Ox Am® from Genencor and Termamyl®, Ban®, Fungamyl® and Duramyl®, all available from Novozymes.

Suitable cellulases include both bacterial or fungal cellulases, preferably with a pH optimum of between 5 and 12. Examples are cellulases produced by a strain of *Humicola insolens* (*Humicola grisea* var. *thermoidea*), particularly the Humicola strain DSM 1800. Other suitable cellulases are cellulases originated from *Humicola insolens* having a molecular weight of about 50 KDa, an isoelectric point of 5.5 and containing 415 amino acids; and a ~43 kD endoglucanase derived from *Humicola insolens,* DSM 1800, exhibiting cellulase activity; a preferred endoglucanase component has the amino acid sequence disclosed in WO 91/17243. Also suitable cellulases are the EGIII cellulases from *Trichoderma longibrachiatum* (WO94/21801, Genencor). Especially suitable cellulases are the cellulases having color care benefits such as described in EP 495 257. Carezyme® and Celluzyme® commercially available from Novozymes are especially useful. Other suitable cellulases for fabric care and/or cleaning properties are described in WO96/34092, WO96/17994 WO95/24471, WO91/17244 and WO91/21801.

Suitable lipases include those produced by the Pseudomonas group, such as *P. stutzeri* ATCC 19.154 (GB1,372,034). Suitable lipases include those showing a positive immunological cross-reaction with the antibody of the Pseudomonas fluorescent llipase AM 1057 available from Amano Pharmaceutical Co. Ltd Japan, under the trade name "Lipase P Amano". Other suitable commercial lipases include Amano-CES, lipases ex *Chromobacter viscosum,* e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands; and lipases ex *Pseudomonas gladioli.*

Especially suitable are the lipases produced by *Pseudomonas pseudoalcaligenes* (EP 218 272) or variants thereof (WO9425578) previously supplied by Gist-Brocades as M1 Lipase$^{R\ and}$ Lipomax$^{R}$. Preferred lipases are the Lipolase$^{R}$ and Lipolase Ultra$^{R}$ from Novozymes. Also suitable are the enzymes described in EP 258 068, EP 943678, WO 92/05249, WO 95/22615, WO 9942566, WO 200060063 (all by Novozymes) and in WO 94/03578, WO 95/35381 and WO 96/00292 by Unilever.

Also suitable are cutinases [EC 3.1.1.50] being considered as lipases which do not require interfacial activation. Suitable cutinases are described in WO88/09367 (Genencor); WO 90/09446 (Plant Genetic System); WO94/14963 and WO94/14964 (Unilever) and WO00/344560 (Novozymes).

Also suitable are bleaching enzymes, the following starch degrading enzymes: Cyclomaltodextrin glucanotransferase "CGTase" (E.C. 2.4.1.19), maltogenic alpha amylase (EC 3.2.1.133) and amyloglucosidase (EC 3.2.1.3); and the following carbohydrases: Mannanase (E.C. 3.2.1.78), protopectinase, polygalacturonase (E.C. 3.2.1.15), pectin lyase (E.C.4.2.2.10), pectin esterase (E.C. 3.1.1.11), pectate lyase (EC4.2.2.2) and Xyloglucanase; especially, the alkaline mannanase selected from the mannanase from the strain *Bacillus agaradhaerens* NICMB 40482; the mannanase from *Bacillus* sp. 1633; the mannanase from *Bacillus* sp. AAI12; the mannanase from the strain *Bacillus halodurans* (all described in WO99/64619) and/or the mannanase from *Bacillus subtilis* strain 168, gene yght described in U.S. Pat. No. 6,060,299; most preferably the one originating from *Bacillus* sp. 1633 and the pectate lyase (described in WO95/25790, WO98/0686, WO98/0687, WO99/27083 and WO99/27083), preferably the pectate lyase described in WO99/27084, WO00/55309 and WO00/75344 from Novozymes.

The enzyme to be incorporated in a detergent composition can be in any suitable form, e.g. liquid, encapsulate, prill, granulate . . . or any other form according to the current state of the art.

Organic Polymeric Compounds

Organic polymeric compounds other than nonionic surfactants suitable for inclusion in the compositions herein include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of m.w. 1000–5000 and their copolymers with maleic anhydride, such copolymers having a molecular weight of from 2000 to 100,000, especially 40,000 to 80,000. Hydrophobically modified types can equally be used. Other organic polymeric compounds suitable for incorporation in the detergent compositions herein include, when they have no other primary function, cellulose derivatives and/or gums (or biopolymers more generally) as well as soil release polymers, dye transfer inhibitor polymers and/or deflocculating polymers. When such polymeric compounds are known to have sequestrant function, they should, if used, preferably be treated in the same way as the sequestrants. Alternatively, they may be omitted from the compositions.

Dye-Transfer Inhibitors

The compositions herein may also comprise from 0.01% to 10%, preferably from 0.05% to 0.5% by weight of polymeric dye transfer inhibiting agents. The polymeric dye transfer inhibiting agents are preferably selected from polyamine N-oxide polymers, copolymers of N-vinylpyrrolidone and N-vinylimidazole, polyvinylpyrrolidone polymers or combinations thereof; these polymers can be cross-linked polymers.

Brighteners

The compositions herein also optionally contain from about 0.005% to 5% by weight of any optical brightener suitable for use in liquid laundry detergents. Preferred brighteners include 4,4',-bis[(4-anilino-6-(N-2-bis-hydroxyethyl)-s-triazine-2-yl)amino]-2,2'-stilbenedisulfonic acid and disodium salt, commercially marketed under the tradename Tinopal-UNPA-GX by Ciba-Geigy Corporation; 4,4'-bis[(4-anilino-6-(N-2-hydroxyethyl-N-methylamino)-s-triazine-2-yl)amino]2,2'-stilbene disulfonic acid disodium salt, commercially marketed under the tradename Tinopal 5BM-GX by Ciba-Geigy Corporation; 4,4'-bis[(4-anilino-6-morphilino-s-triazine-2-yl)amino]2,2'-stilbenedisulfonic acid, sodium salt, commercially marketed under the tradename Tinopal-DMS-X and Tinopal AMS-GX by Ciba Geigy Corporation.

Alkoxylated Amine, Imine, Amide, Imide Compound

The composition can comprise one or more polymeric compounds, including mixtures of such compounds, having at least two in-chain or side-chain amine, imine, amide or imide groups, preferably a polyamide, polyimide or more preferably a polyamine or polyime compound wherein one or more of said groups is substituted by $C_2$–$C_3$ alkoxylation or polyalkoxylation. Preferred are compounds having at least two amine, imine, amide or imide groups each having from one to 80 alkyoxylate groups, preferably at least 5, and wherein the alkoxylation is derived from $C_2$ alkylene oxide, i.e., ethylene oxide and/or from $C_3$ alkylene oxide, i.e., propylene oxide and further wherein the polyalkoxylation is predomonantly or exclusively in side-chains. Preferred are compounds having a weight average molecular weight of 200 to 50,000, preferably to 20,000 or even to 10,000, or even from 350 to 5000 or even to 2000 or even to 1000. Preferably the composition herein comprises (by weight of the composition) from 0.5% to 15%, more preferably from 0.8% to 10%, more preferably form 1.5% to 8%, more preferably from 2.0% or even 2.5% or even 3% to 6% of said alkoxylated compound. Highly preferred are ethoxylated poly(ethyleneimine), preferably having an average ethoxylation degree per ethoxylation chain of 15 to 25, and a molecular weight of 1000–2000 dalton. Also highly preferred are ethoxylated tetraethylene pentaimines. Other suitable derivatives in this class are disclosed in patents and patent applications of BASF and Procter & Gamble.

Perfume

Preferred compositions herein include perfumed types. Commercially available perfumes for liquid detergent application are available from IFF, Firmenich, Takasago, Givaudan and other suppliers and can be used at levels of from trace amounts. e.g., above or even below the level of olfactory detection for any single perfumery ingredient to above 5% of the composition for the perfume taken as a whole. The term "perfume" includes also perfume or fragrance precursors such as pro-perfumes, as well as essential oils or other perfumery ingredients such as fixatives and botanicals. Perfume deposition may be assisted by use of any suitable carrier including viscous oils, polymers, silicones, zeolites, carbohydrates, biopolymers, and the like and perfumes for use herein can be encapsulated, microencapsulated or can be subjected to any treatment necessary for compatibility with other ingredients and/or to assist or promote deposition. Preferred compositions suitably comprise from 0.01% to 4% of perfume, more preferably from 0.1% to 2%.

Other Optional Ingredients

Other optional ingredients suitable for inclusion in the composition herein include colours, opacifiers, pearlescent agent, process aids, anti-oxidants, bactericides, buffering agents and hydrogen peroxide. Highly preferred are also perfume, brightener, buffering agents (to maintain the pH preferably from 5.5 to 9, more preferably 6 to 8), fabric softening agents including cationic softeners and/or clays and/or silicones, e.g., as used in softergents and shampoos. Of these, the silicones are more highly preferred. Bleaching compositions can be made without a compound formally recognized as a bleach or bleach precursor, simply by including any known synthetic or biological bleach catalyst which will react with dissolved oxygen from the air in the wash bath to form in-situ a bleach-active species. However, those catalysts tending to result in indiscriminate free radical chemistry are preferably avoided.

Preferably, the liquid detergent compositions are substantially free of any compounds susceptible to interact with the water-soluble film in a way that impairs its dissolution upon contact with water. Such compounds are for instance the C1–C8 monocarboxylic acids and their salts, boric acid and borate salts, and formaldehyde, occasionally coming as an impurity with some raw materials.

Other Builders/Chelants

Although not preferred, the compositions of the present invention may contain, preferably at a limited level, water-insoluble builder compounds, such as those operating as ion exchangers, typically present in detergent compositions at a level of from 0.5% to 60% by weight, preferably from 5% to 20% by weight of the liquid detergent composition. Such materials are non-limitingly illustrated by the aluminosilicates such as zeolite A, zeolite P and/or crystalline layered silicates such as SKS-6, available from Clariant. These materials, especially when having spheroidal geometry, e.g., zeolite A, can also be useful, e.g., in minor amounts as agglomeration initiators. The latter use rather than high-level use is highly preferred herein.

While environmental friendly P-free compositions are encompassed herein, the detergent compositions of the invention may also comprise if desired a phosphate-containing builder material suitably at a level of from 2% to 40%, more preferably from 3% to 30%, more preferably from 5% to 20% by weight of the composition. Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Laundry Methods

Preferably the composition of the present invention is used for cleaning or care of laundry. The pouch dissolves or disintegrates in water to deliver the laundry detergent containing particles to the washing cycle. Laundry detergent compositions in pouch form may be used by placing them in a dosing drawer of an automatic laundry washing machine or by placing them directly in the drum of the machine with the garments to be laundered. Typically, the pouch is added to the drum of a domestic laundry automatic washing machine. The pouches are quite large, e.g., from about 5 ml to about 100 ml capacity, typically at least 20 ml. One or two of pouches is commonly used per wash load.

Preferably, the pouch comprises all of the detergent ingredients of the detergent composition used in the washing. Although it may be preferred that some detergent ingredients are not comprised by the pouch and are added to the washing cycle separately. In addition, one or more detergent compositions other than the detergent composition comprised by the pouch can be used during the laundering process, such that said detergent composition comprised by the multi-compartment pouch is used as a pre-treatment, main-treatment, post-treatment or a combination thereof during such a laundering process.

Process—Second Embodiment

The Fine Dispersion/Mixing and Granulation/Agglomeration

The terms "dispersion/mixing" and/or "granulation/agglomeration," as used herein, refer to mixing and/or granulation/agglomeration in a fine dispersion mixer at a blade tip speed of from about 5 m/sec. to about 50 m/sec., unless otherwise specified. The total residence time of the mixing and granulation process is preferably in the order of from 0.1 to 10 minutes, more preferably 0.1–5 and most preferably 0.2–4 minutes. The more preferred mixing and granulation tip speeds are about 10–45 m/sec. and about 15–40 m/sec. Any apparatus for mixing/agglomeration, any of a number of mixers/agglomerators can be used. In one preferred embodiment, the process of the invention is continuously carried out. Especially preferred are mixers of the FukaeR FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other suitable mixers include DiosnaR V series ex Dierks & Sohne, Germany; and the Pharma MatrixR ex T K Fielder Ltd., England and the FujiR VG-C series ex Fuji Sangyo Co., Japan; and the RotoR ex Zanchetta & Co srl, Italy. Other suitable equipment can include EirichR, series RV, manufactured by Gustav Eirich Hardheim, Germany; Lodige, series FM for batch mixing, series Baud KM for continuous mixing/agglomeration, manufactured by Lodige Machinenbau GmbH, Paderborn Germany; Drais T160 series, manufactured by Drais Werke GmbH, Mannheim Germany; and Winkworth RT 25 series, manufactured by Winkworth Machinery Ltd., Bershire, England.

The Littleford Mixer, Model #FM-130-D-12, with internal chopping blades and the Cuisinart Food Processor, Model #DCX-Plus, with 7.75 inch (19.7 cm) blades are two further examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

Particle Preparation

Coating of the solid core material comprising a sprayed fine dispersion/mixture of the sequestrant powders can be accomplished using any conventional coating techniques, including those which provide a continuous, unbroken coating around the sequestrant (mixture) core material.

However applied, the coating material can completely surround the core and insulate the sequestrant (mixture) material therein from contact with the non-aqueous solution in the non-aqueous cleaning products in which such coated sequestrant particles are employed, or, surprisingly and more economically, complete surrounding is not needed.

Complete coating when desired is best accomplished by a fluidized bed coating/cooling operation. In such a procedure, melted polyethyleneglycol (PEG4000 or higher, e.g., PEG8000) is sprayed onto the dispersion/mixture of the sequestrant, for instance a mixture of citrate/phosphonate powders to be coated in a fluidized bed arrangement such as for example in a Wurster coater.

The sprayed particles in the fluidized bed are then cooled with dehumidified air maintained at a temperature below the melting point of the Polyethyleneglycol e.g., below about 40° C. for PEG4000. In this manner, a coating which comprises from about 1% to 40% by weight of the coated particles, more preferably from about 1% to 10% by weight of the coated particles, can typically be obtained.

The coated particles which result will frequently range in size from about 20 to 800 microns. More preferably, coated activator particles of from 20 to 400 microns can be realized. Intermediate sized coated particles ranging in size from about 20 to 80 microns, can be advantageous for suspension in liquid non-aqueous detergent and bleach compositions in that they minimize the suspension requirement for the particles in the liquid compositions and in that they can produce improved consumer aesthetics.

Examples:

The following compositions were prepared according to the invention. The levels are expressed in % by weight of the liquid detergent composition. Composition of example I comprises Na4 HEDP, being per se less than 0.3% wt soluble in the liquid composition. Composition of example 11 comprises Na3 citrate embedded in Polyethyleneglycol by agglomeration. Composition of example III comprises two sequestrants: Na3 citrate, Na4HEDP in particles coated with Polyethyleneglycol.

| Liquid Detergent Composition | I % wt | II % wt | III % wt |
|---|---|---|---|
| Liquid matrix | | | |
| Propane diol | 17.1 | 16.9 | 16.7 |
| Monoethanolamine | 8.7 | 8.6 | 8.5 |
| Dodecyl Benzene Sulphonic Acid | 23.9 | 23.7 | 23.4 |
| Amido propyl dimethyl amine | 1.9 | 1.9 | 1.9 |
| C13/15 alcohol ethoxylated 7 | 20.3 | 20.1 | 19.9 |
| C12-C18 Fatty acids | 18.1 | 17.9 | 17.7 |
| Ethoxylated Tetra Ethylene Pentamine | 1.7 | 1.7 | 1.6 |
| Poly Ethylene Imine Ethoxylate | 1.7 | 1.7 | 1.6 |
| Disulphonated diamino stilbene based fluorescent whitening agent | 0.3 | 0.3 | 0.3 |
| Perfume | 1.7 | 1.7 | 1.7 |
| Solids | | | |
| Dequest 2016D | 1.5 | — | — |
| Particle 1 | — | 2.5 | — |

-continued

| Liquid Detergent Composition | I % wt | II % wt | III % wt |
|---|---|---|---|
| Particle 2 | — | — | 3.7 |
| Water and miscellaneous | 3.1 | 3.0 | 3.0 |
| (suds suppressors, aesthetics, structuring agent, enzymes, pH adjusters . . . ) | | | |
| Total (%) | 100 | 100 | 100 |

Dequest 2016D: Hydroxy Ethylidene 1,1 Di Phosphonic acid (HEDP) Tetra Sodium salt (59% as acid) from Solutia Europe. The above compositions demonstrate good stain removal and cleaning performance together with a good dissolution profile.

Preparation

The liquid composition is prepared by adding the surfactants (Dodecyl benzene sulphonic acid, amido propyl dimethyl amine, C13/15 alcohol ethoxylated 7) to a mixture of monoethanolamine and propanediol. While mixing, the following ingredients are added sequentially: fatty acids, ethoxylated tetra ethylene pentamine, polyethyleneimine ethoxylate, fluorescent whitening agent and perfume. The sequestrants are then added. When used, the structurant (e.g. hydrogenated castor oil derivative) is preferably added as last ingredient. The liquid detergent compositions are then poured in PVA pouches (Monosol 8630).

Preparation of Sequestrant Particle by Agglomeration (Particle 1)

1. A Braun food processor (Type 9210 made in Germany) used as a mixer/agglomerator is loaded with anhydrous Na3Citrate powder (supplier Gadot) (with a mean particle size distribution below 100 micron).
2. The ingredients are dispersed/mixed for 30 seconds using the Braun speed setting of 8.
3. Polyethylene glycol with a mean molecular weight of 8000 (PEG8000) is added slowly at a temperature of 65° C. to form a fine dispersion/granulation.
4. The Na3Citrate and the PEG8000 are further agglomerated in the Braun food processor at a speed setting of 8 mentioned on the equipment until discrete granules were formed.
5. The agglomerates are transferred into a plastic bag and zeolite is added to the agglomerates. The plastic bag is filled with air and twisted around to achieve good mixing from the agglomerates with the zeolite acting as a flow aid
6. The agglomerates are screened in a Rotap screening devise and the particles retained between 1180 and 250 micron. Other particle size ranges are equally accessible.

| Raw Material | Composition by weight of the particle |
|---|---|
| Anhydrous Na3 Citrate | 60 |
| PEG 8000 | 36 |
| Zeolite as flow aid | 4 |
| Total | 100 |

Preparation of Sequestrant Particle by Coating (Particle 2)

1. A Glatt fluid bed dryer/cooler is loaded with a mix comprising anhydrous Na3Citrate powder (supplier Gadot) (with a mean particle size distribution below 100 micron) and Dequest 2016D (mean particle size between 100–200 microns).
2. The ingredients are fluidised at room temperature.
3. Polyethylene glycol with a mean molecular weight of 8000 (PEG 8000) is sprayed on at a temperature of 65° C. coating the mixture with a layer of polyethyleneglycol.
4. The coated material is then cooled down using cold air from 10° C. for 10 minutes.
5. Zeolite is added as flow aid to the coated material and an other 5 minutes cooled/fluidized in the fluid bed dryer/cooler.
6. The particles are screened in a Rotap screening devise and the particles retained between 500 and 125 micron. Other particle size ranges are equally accessible.

| Raw Material | Composition by weight of the particle |
|---|---|
| Anhydrous Na3 Citrate | 40 |
| Dequest 2016D | 31 |
| PEG 8000 | 25 |
| Zeolite as flow aid | 4 |
| Total | 100 |

What is claimed is:

1. A pouch made from a water-soluble film, said pouch containing a liquid composition comprising:

(a) less than about 5% by weight of the liquid composition, of water;

(b) an anionic surfactant; and (c) at least about 0.5% by weight of the liquid composition of a solid builder/chelant which is free of $C_{8-22}$ alkyl or alkenyl chains;

wherein less than about 0.3% by weight of the liquid composition, of said solid builder/chelant is dissolved in said liquid composition;

wherein said solid builder/chelant comprises a material selected from the group consisting of tetrasodium salt of hydroxy-ethylidene 1,1-di-phosphonic acid, trisodium salt of citrate, and mixture thereof and wherein said builder/chelant is in the form of a coated, encapsulated or agglomerated solid particle comprising a polyethylene glycol binder which is substantially insoluble in the liquid cleaning composition.

2. A pouch according to claim 1 wherein less than about 0.1% by weight of the liquid composition of said solid builder/chelant is dissolved in said liquid composition.

3. A pouch according to claim 2 wherein said solid builder/chelant comprises from about 0.75% to 10% by weight of the liquid composition.

4. A pouch according to claim 3 wherein said solid builder/chelant comprises tetrasodium salt of hydroxyethylidene 1,1-di-phosphonic acid.

5. A pouch according to claim 1 wherein the is polyethyene glycol binder has weight of about 4000 to 8000 daltons.

6. A pouch according to claim 1 wherein the anionic surfactant is comprised at a level of from 7.5% to 70% by weight of the liquid composition.

7. A pouch according to claim 6 wherein the anionic surfactant comprises from about 15% to 35% by weight of the liquid composition and the liquid composition further comprises less than about 1% by weight of the liquid composition, of water.

8. A pouch according to claim 7 wherein said liquid composition is further characterized by having a viscosity of from about 50 to 10,000 mPas, measured at a rate of 20 $s^{-1}$.

9. A pouch according to claim 8 wherein said liquid composition further comprises a rheology control agent and wherein said liquid composition has a viscosity of from about 300 to 600 mPAs, measured at a rate of 20 $s^{-1}$.

10. A pouch according to claim 9 wherein said rheology control agent is selected from the group consisting of hydrogenated castor oil; ultra-long chain saturated straight-chain hydrocarbons, organogelants, biopolymers and mixtures thereof.

11. A pouch according to claim 1 wherein said film comprises a polymer selected from the group consisting of polyvinyl alcohols, polyvinyl alcohol copolymers, hydroxypropyl methyl cellulose, and mixtures thereof.

12. A process for making a pouch according to claim 1, which process comprises the steps of:

(a) formulating said liquid composition with a solid builder/chelant which is free of $C_{8-22}$ alkyl or alkenyl chains and which is less than about 0.3% by weight of the liquid composition, soluble in said liquid composition; and (b) incorporating such liquid composition within a water-soluble pouch-forming film material;

wherein the solid builder/chelant comprises a material selected from the group consisting of tetrasodium salt of hydroxy-ethylidene 1,1-di-phosphonic acid, trisodium salt of citrate, and mixtures thereof.

13. A method of using the pouch product of claim 1, which method comprises adding said pouch to the dispensing drawer or drum of an automatic laundry washing machine and thereafter using said automatic washing machine to launder garments.

14. A method according to claim 13 wherein during the use of said washing machine to launder garment the wash cycle lasts from about 5 to 50 minutes.

15. A pouch made from a water-soluble film, said pouch containing a liquid composition comprising:

(a) less than about 5% by weight of the liquid composition, of water;

(b) an anionic surfactant, and (c) from about 0.75% to about 10% by weight of the liquid composition of a solid builder/chelant which is free of $C_{8-22}$ alkyl or alkenyl chains;

wherein less than about 0.1% by weight of the liquid composition, of said solid builder/chelant is dissolved an said liquid composition;

wherein said solid builder/chelant comprises tetrasodium salt of hydroxyethylidene 1,1-di-phosphonic acid and wherein said builder/chelant is in the form of a coated, encapsulated or agglomerated solid particle comprising a polyethylene glycol binder which is substantially insoluble in the liquid cleaning composition.

16. A pouch made from a water-soluble film, said pouch containing a liquid composition comprising:

(a) less than about 5% by weight of the liquid composition, of water;

(b) an anionic surfactant; and (c) from about 0.75% to about 10% by weight of the liquid composition of a solid builder/chelant which is free of $C_{8-22}$ alkyl or alkenyl chains;

wherein less than about 0.1% by weight of the liquid composition, of said solid builder/chelant is dissolved in said liquid composition;

wherein said solid builder/chelant comprises a material selected from the group consisting of tetrasodium salt of hydroxy-ethylidene 1,1-di-phosphonic acid, trisodium salt of citrate, and mixture thereof and is in the form of a coated, encapsulated or agglomerated solid particle comprising a polyethylene glycol binder which is substantially insoluble in the liquid cleaning composition.

* * * * *